United States Patent [19]

Morii et al.

[11] Patent Number: 4,971,302

[45] Date of Patent: Nov. 20, 1990

[54] SHEET STAPLING APPARATUS

[75] Inventors: Nobuyuki Morii, Okazaki; Nobuo Koike, Ena; Takashi Komada; Nobuyoshi Tomioka, both of Okazaki, all of Japan

[73] Assignee: Ricoh Company, Ltd., Tokyo, Japan

[21] Appl. No.: 347,436

[22] Filed: May 2, 1989

[30] Foreign Application Priority Data

May 6, 1988 [JP] Japan ..... 63-109949

[51] Int. Cl.[5] ..... B42B 1/02

[52] U.S. Cl. ..... 270/53; 270/58

[58] Field of Search ..... 270/53, 37, 58; 355/324; 227/50, 99, 100

[56] References Cited

U.S. PATENT DOCUMENTS

| | | | |
|---|---|---|---|
| 4,361,393 | 11/1982 | Noto | 270/53 |
| 4,376,529 | 3/1983 | George | 270/53 |
| 4,564,185 | 1/1986 | Hamlin | 270/53 |
| 4,566,782 | 1/1986 | Britt | 270/53 |
| 4,762,312 | 8/1988 | Ushirogato | 270/53 |

FOREIGN PATENT DOCUMENTS

| | | |
|---|---|---|
| 59-69346 | 4/1984 | Japan . |
| 62-244869 | 10/1987 | Japan . |

*Primary Examiner*—Carl D. Price
*Assistant Examiner*—Therese M. Newholm
*Attorney, Agent, or Firm*—Oblon, Spivak, McClelland, Maier & Neustadt

[57] ABSTRACT

A stapling apparatus used with a sheet sorter having a plurality of bins comprises a stapler-head which is moved along one side edge of the bins toward one of predetermined positions at which the stapler-head confronts the one side edge of the bins. A sheet attracting unit is also moved along the one side edge of the bins toward one of predetermined positions at which the sheet attracting unit confronts the one side edge of the bins. The sheets stacked on one of the bins are chucked by the sheet attracting unit and moved by the sheet attracting unit outwardly from one side edge of the bin to a position at which the stapler-head becomes able to staple the sheet. The sheet attracting unit being movable along the one side edge of each of the bins and able to be stopped at each of predetermined positions at which the sheet attracting unit confronts the one side edge of the bins. Movable fences are provided on the bins, respectively, for aligning the sheets on the respective bins. A fence releasing mechanism is provided for releasing each of the fences in accordance with the movement of the stapler-head along the one side edge of the bins.

13 Claims, 5 Drawing Sheets

SHEET STAPLING APPARATUS

BACKGOUND OF THE INVENTION

The present invention relates to a sheet stapling apparatus employed in combination with a sheet sorter which, in turn, is employed with a recording apparatus such as a copying machine, printing machine or the like. More particularly, the invention relates to a sheet stapling apparatus for stapling each of sets of sheets which are respectively stacked on a plurality of bins or trays (referred to as bins hereinafter) of a sorter in accordance with a sorting operation of the sorter.

For the purpose of stapling each of sets of sheets stacked on a plurality of vertically arrayed bins of a sorter after sorting operation thereof, there has been employed a sheet stapling apparatus in combination with such sorter.

In an exemplary sheet stapling apparatus described in Japanese patent application Laid Open (KOKAI) No. 59-69346, a stapler-head for striking a staple into each set of sheets stacked on each bin is moved vertically along one side edge of the bins toward one of predetermined positions which are vertically spaced from one another with an interval corresponding to an interval between the bins. In each predetermined position, the stapler-head confronts the side edge of the corresponding bin on which a set of sheets to be stapled are stacked. After arriving at one of the predetermined positions, the stapling head is moved horizontally toward the side edge of the corresponding bin to a position at which the sheets stacked on the bin can be stapled by the stapler-head. Comparatively complicated supporting and controlling mechanisms for moving the stapler-head in vertical and horizontal directions are required with stapling apparatuses of this kind. Such stapling apparatuses are, therefore, generally bulky in size, complex in construction and thus costly in manufacturing thereof.

In another sheet stapling apparatus described in Japanese patent application Laid Open (KOKAI) No. 62-244869, a stapler-head is moved vertically along one side edges of the bins toward one of predetermined positions which are vertically spaced from one another with an interval corresponding to an interval between the bins. In each predetermined position, the stapler-head confronts the side edge of the corresponding bin on which a set of sheets to be stapled are stacked. After arriving at one of its predetermined positions, the corresponding bin on which the sheets to be stapled are stacked is moved horizontally toward the stapler-head to a position at which the sheets stacked on the bin can be stapled by the stapler-head. Comparatively complicated supporting and controlling mechanisms for moving the stapler-head in a vertical direction and for moving each of the bins in a horizontal direction are required with stapling apparatuses of this kind. Such stapling apparatuses are, therefore, generally bulky in size, complex in construction and thus costly in manufacturing thereof. Moving the bin in a horizontal direction causes the sheets to become in an irregular state due to a mechanical vibration of the bin. As the result, the sheets tend to be stapled in an irregularly arranged state.

SUMMARY OF THE INVENTION

It is therefore an object of the present invention to provide a simple and compact stapling apparatus used with a sheet sorter having a plurality of bins for storing thereon sorted sheets, which can decrease a manufacturing costs thereof.

It is another object of the present invention to provide a simple and compact stapling apparatus used with a sheet sorter having a plurality of bins for storing thereon sorted sheets, which can minimize the possibility of stapling of sets of sheets in an irregularly arranged state.

It is a further object of the present invention to provide a simple and compact stapling apparatus used with a sheet sorter having a plurality of bins for storing thereon sorted sheets, which has movable fences for aligning the sheets stacked on the bins and a simple and compact fence-releasing mechanism for moving each of the fences so as to enable stapling of the sheets.

According to one aspect of the present invention, there is provided a stapling apparatus used with a sheet sorter having a plurality of bins for storing thereon sheets sorted by the sheet sorter, comprising: a stapler-head for striking at least one staple into the sheets stacked on each of the bins near one side edge of the sheets, the stapler-head being movable along one side edge of the bins and able to be stopped at each of predetermined positions at which the stapler-head confronts one side edge of the bins; and a sheet attracting unit for chucking the sheets stacked on each of the bins near the one side edge of the sheets and for moving the sheets outwardly from one side edge of the corresponding bin to a predetermined position at which the stapler-head becomes able to strike the staple into the one side edge of the sheets, the sheet attracting unit being movable along the one side edge of the bins and able to be stopped at each of predetermined positions at which the sheet attracting unit confronts the one side edge of the bins.

In the stapling apparatus having the above-mentioned construction, after the stapler-head arrives at a predetermined position at which the stapler-head confronts one side edge of the bin on which the sheets to be stapled is stacked, the sheets stacked on the bin are chuked by the attracting unit and, then, attracted by the sheet attracting unit from the one side edge of the bin to a predetermined position at which the stapler-head becomes able to strike the staple into the one side edges of the sheets. This means that it is unnecessary to move the stapler-head from the above-mentioned predetermined position toward the bin, and it is also unnecessary to move each of bins toward the stapler-head. Accordingly, the present inevention has an advantage in that it can provide a simple and compact stapling apparatus which can be manufactured in low cost. Further, since the bin storing thereon the sheets to be stapled does not move toward the stapler-head in the stapling apparatus of the present invention, the possibility of generation of an irregular state in the sheets can be minimized, and accordingly, the sheets can be stapled in a regularly aligned state.

According to another aspect of the present invention, the sheet attracting unit comprises a chucking unit for chucking and releasing the sheets stacked on each of the bins, and a reciprocating mechanism for reciprocating the chucking unit in substantially a horizontal direction between a first position at which the chucking unit becomes able to chuck the one side edge of the sheets stacked on each of the bins and a second position at which the stapler-head becomes able to strike the staple into the one side edge of the sheets.

In the stapling apparatus having the above-mentioned construction, since the sheets can be firmly chucked by the chucking members during attracting operation of the chucking unit, the possibility of generation of an irregular state in the sheets during the attracting operation can be minimized, and accordingly, the sheets can be stapled in a regularly aligned state.

According to a further aspect of the present invention, the stapling apparatus further comprises: a plurality of fences for aligning the one side edge of the sheets stacked on the respective bins, each of the fences being movably attached to the corresponding bins for movement in opposite directions between an upstanding position thereof at which the fence forms a surface for making contact with the one side edge of the sheets stacked on the corresponding bin and a releasing position thereof at which the fence permit the one side edge of the sheets stacked on the corresponding bin to move outwardly from the one side edge of the corresponding bin; a plurality of spring members provided on the bins, respectively, for forcing the respective fences to move toward the upstanding positions thereof; and an operating mechanism for moving the fences from the upstanding positions thereof to the releasing positions thereof against the spring members, respectively, in accordance with the movement of the stapler-head along the one side edge of the bins so as to maintain the fences in the respective releasing positions, when the stapler-head is maintained in the predetermined respective positions.

In the stapling apparatus having the above-mentioned construction, the sheets to be stapled, which are stacked on the bin, are aligned by the fence maintained in its upstanding position, before the sheets are chucked by the chucking unit. Therefore, the sheets can be stapled in a regularly aligned state. Further, since each of the fences is moved from its upstanding position to its releasing position for permitting the attraction of the sheets stacked on the corresponding bin in accordance with the movement of the stapler-head along the one side edge of the bins, it is unnecessary to provide an exclusive drive mechanism for opening or releasing each of the fences. Accordingly, it is possible to provide a comparatively simple and compact stapling apparatus which can effect an excellent stapling operation on the sheet.

In the preferred embodiments of the present invention, a plurality of bins are vertically arrayed in multiple stage, and the stapler-head and the sheet attracting unit are moved in unison in a vertical direction along the one side edge of the bins.

Further objects and advantages of the present invention will become apparent from the following description of the preferred embodiments of the invention as illustrated in the accompanying drawings.

DESCRIPTION OF THE PREFERRED EMBODIMENTS

Figure 1:
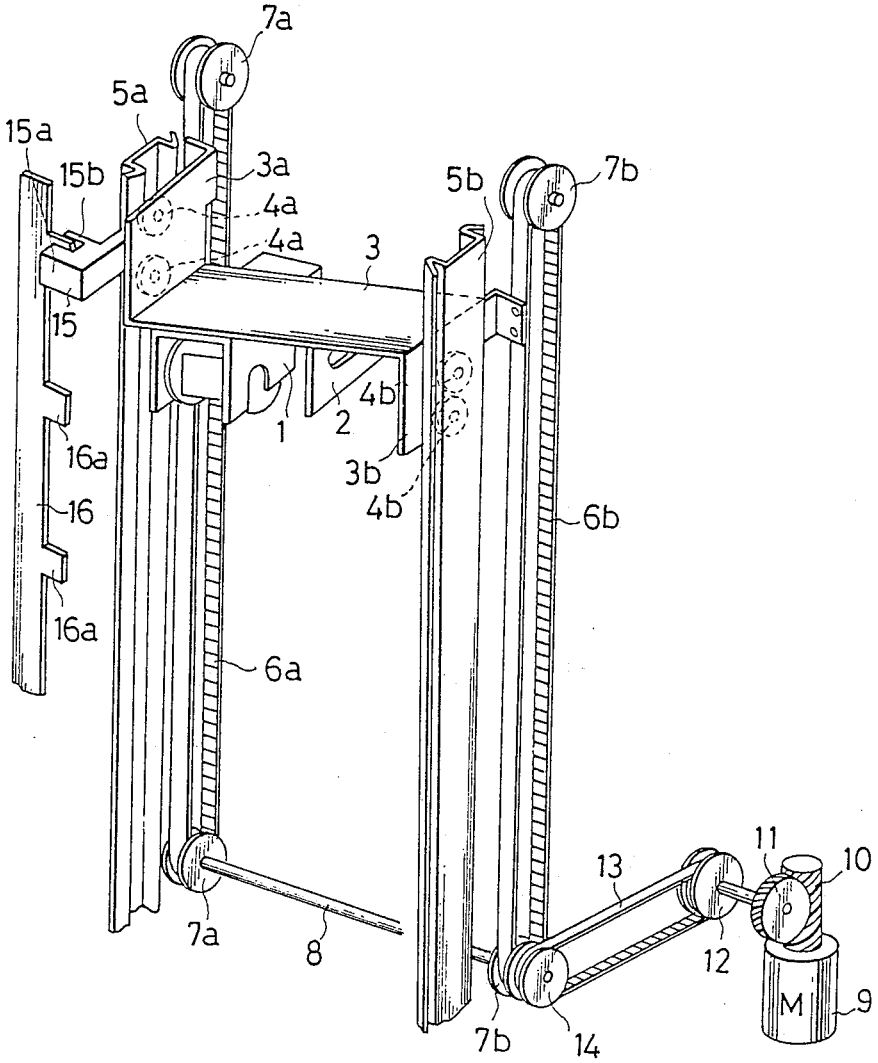
FIG. 1 is a partial perspective view schematically illustrating a sheet stapling apparatus which is used in combination with a sorter according to one preferred embodiment of the present invention.
Figure 2:
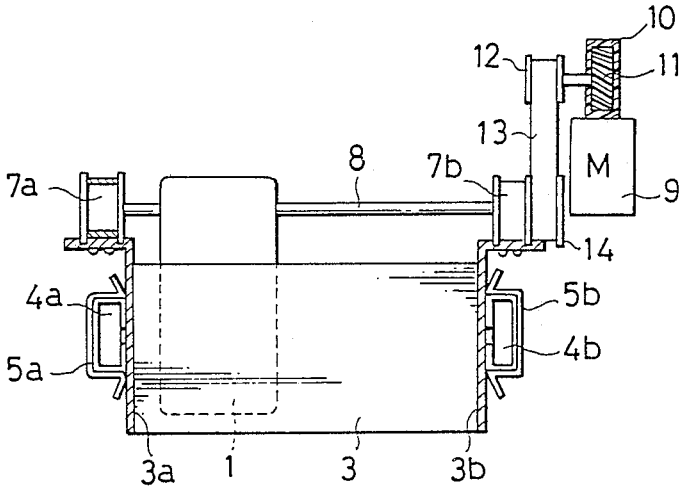
FIG. 2 is a partial plan view, partially in section, schematically illustrating the sheet stapling apparatus shown in FIG. 1.

FIGS. 1 to 11 illustrate a stapling apparatus according to one preferred embodiment of the present invention. The stapling apparatus is used in conbination with a sheet sorter (not particularly shown) provided for sorting sheets, such as copy papers, discharged from a recording apparatus such as a copying machine or a printing machine. The sheet sorter comprises a plurality of bins, such as a bin 23, which are vertically arrayed in multiple stage. The sheet sorter may be of a shiftable bin type or a fixed bin type. The sheets are stacked on the bins in accordance with a sorting operation of the sheet sorter. The stapling apparatus shown in FIGS. 1 and 2 is disposed near one side edge of the bin.

Figure 3:
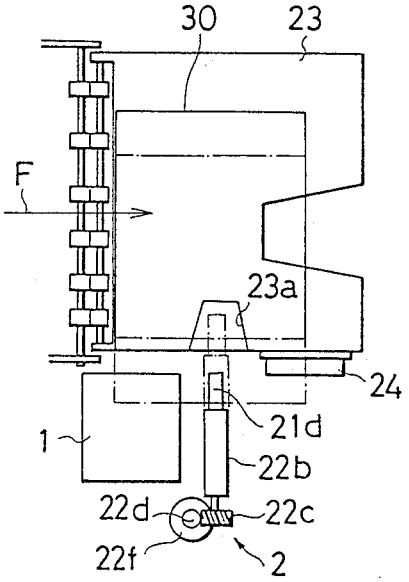
FIG. 3 is a schematic plan view showing the arrangement of the stapler-head and sheet attracting unit shown in FIG. 1.

Referring to FIGS. 1 to 3, the stapling apparatus comprises a conventional stapler-head 1 and a sheet attracting unit 2 which are secured to and suspended downwardly from a base bracket 3. As best seen in FIG. 3, the stapler-head 1 is provided for striking a staple into a stack of sheets 30 stored on each bin 23, while the sheet attracting unit 2 is provided for attracting the stack of sheets 30 in a substantially horizontal direction from an initial position on each bin 23 to a position at which the stack of sheets 30 can be stapled by the stapler-head 1.

Vertically extending in parallel to each other along the one side of each bin are stationary guide rails **5*a* and 5*b* for vertically guiding the bracket 3. Between the two guide rails 5*a* and 5*b* the bracket 3 has opposite ends 3*a* and 3*b* bent in upward and downward directions, respectively. To smoothly guide the bracket 3 along the guide rails, rollers 4*a* and 4*b* are rotatably attached to the bracket ends 3*a* and 3*b* and received in grooves formed in the guide rails 5*a* and 5*b***, respectively.

Vertically arranged in parrarel to each other along the one side of each bin are drive belts **6*a* and 6*b*, such as timing belts, to which the bracket 3 is secured at its opposite ends 3*a* and 3*b* by screws or the like. Vertically spaced end pulleys 7*a* and 7*b* are provided for supporting the drive belts 6*a* and 6*b*, respectively. In this embodiment, the upper end pulleys are idlers, and the lower end pulleys 7*a* and 7*b* are integrally rotatable through a drive shaft 8 which is driven by a drive motor 9 through a power transmission mechanism. In this embodiment, the power transmission mechanism comprises a first gear 10 secured to an output shaft of the drive motor 9, a second gear 11 meshing with the first gear 10, a first power transmission pulley 12 formed integrally with the second gear 11, a second power transmission pulley 14 secured to the drive shaft 8, and a timing belt 13 passed between the pulleys 12 and 14. Rotating the drive shaft 8 in forward and reverse directions by the motor 9 causes the bracket 3** to move in upward and downward directions.

To stop the stapler-head 1 at predetermined positions at which the stapler-head 1 confronts the one side edge of the bins, respectively, there is provided a position detecting mechanism which comprises a position sensor 15 seured to the bracket 3 and a stationary pillar 16 extending along the one side of each bin. The pillar 16 is formed with projections 16*a* which ar vertically spaced from one another with an interval which corresponds to an interval between the bins. The position sensor 15 is formed with two spaced arm portions 15*a* and 15*b* and constructed to detect each pillar projection 16*a* when each projection 16*a* is disposed between the sensor arm portions 15*a* and 15*b*. Based on the detection of one of the piller projections 16*a* by the position sensor 15, the drive motor 9 is controlled to stop the stapler-head 1 at one of the predetermined positions.

Figure 4:
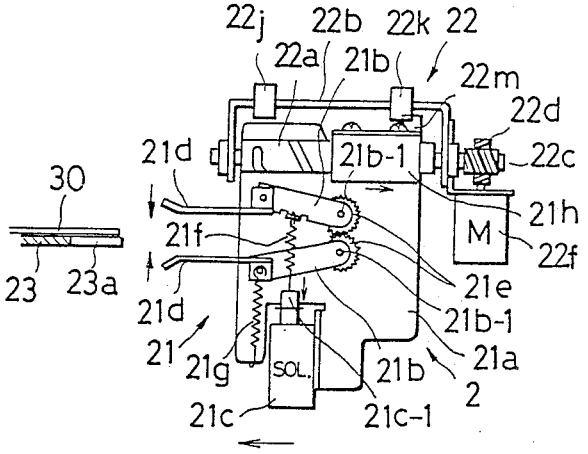
FIGS. 4 to 9 are schematic side views illustrating the operative state of the sheet attracting unit shown in FIG. 3.

As shown in FIG. 4, the sheet attracting unit 2 comprises a chucking unit 21 for chucking one side of a stack of the sheets 30 stored on the bin 23 and a reciprocating mechanism 22 for reciprocating the chucking unit 21 substantially in the horizontal direction. The chucking unit 21 comprises a base plate 21*a* arranged in such a manner that one side edge of the base plate 21*a* confronting the one side of each bin vertically extends substantially in perpendicular to the one side of each bin. A pair of vertically spaced swingable arms 21*b*, each integrally formed at one end thereof a pivot pin 21*b*-1, are pivotably mounted on the base plate 21*a* through the pivot pins 21*b*-1, respectively. Extending from the tip or free ends of the swingable arms 21*b* toward the bins are chuck plates 21*d* which are secured to the arms 21*b*, respectively, for chucking therebetween the sheets 30 to be stapled. Integrally provided with the arm pivot pins 21*b*-1 are gears 21*e* which intermesh with each other so as to enable symmetrical swing movements of the arms 21*b* with respect to each other. Accordingly, as the upper arm is swung upwardly and downwardly about the upper pivot pin, the lower arm is swung downwardly and upwardly about the lower pivot pin, thereby moving the chuck plates 21*d* toward their open and closed positions.

An actuating unit for moving the chuck plates 21*d* between their open and closed positions is provided on the base plate 21*a*. The actuating unit comprises a solenoid 21*c* which is located under the arms 21*b* and secured to the base plate 21*a*. The solenoid 21*c* has an output rod 21*c*-1 which is forced to move downwardly when the solenoid 21*c* is energized. The upper swingable arm 21*b* is connected to the solenoid output rod 21*c*-1 through a first tension spring 21*f*. On the other hand, the lower arm 21*b* is connected to an upper end of a second tension spring 21*g* which in turn is connected at its lower end to the base plate 21*a* so as to force the lower arm 21*b* to move downwardly. The second tention spring 21*g* has a spring force which is larger than that of the first tension spring 21*f*. Accordingly, when the solenoid 21*c* is energized, the arms 21*b* are moved to and then maintained in their closed positions by a drive force of the solenoid 21*c*, while when the solenoid 21*c* is deactivated, the arms 21*b* is moved to and then maintained in their open positions by a spring force of the second tension spring 21*g*. As seen in FIG. 3, each bin 23 is formed at its one side with a notch 23*a* for accomodating the lower chuck plates 21*d*.

Referring to FIG. 4, the reciprocating mechanism 22 comprises a support frame 22*b* secured to the bracket 3 and having at opposite ends thereof leg portions facing each other and a feed shaft 22*a* which horizontally extends substantially in perpendicular to the one side of each bin 23 and rotatably supported to the leg portions of the support frame 22*b*. The feed shaft 22*a* is provided for reciprocating the chucking unit 21 substantially in a horizontal direction so as to advance and return the same with respect to the one side of the bin 23. Secured to one end of the feed shaft 22*a* at the outside of the frame 22*b* is a worm gear 22*c* which is positioned in driving engagement with a worm shaft 22*d* secured to an output shaft of the drive motor 22*f* so as to transmit forward and reverse rotations of the motor 22*f* to the feed shaft 22*a*. The feed shaft 22*a* is formed in the form of a ballscrew shaft. Secured to the base plate 21*a* and positioned in threaded engagement with the feed shaft 22*a* is a boss member 21*h* which is formed in the form of a ball-screw nut. Rotating the feed shaft 22*a* in forward and reverse directions by a drive force of the motor 22*f* causes the chucking unit base plate 21*a* to reciprocate forward and backward directions in parallel to the feed shaft 22*a*.

Figure 5:
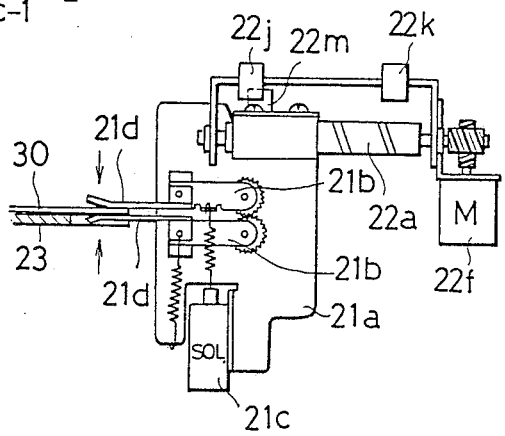
Figure 6:
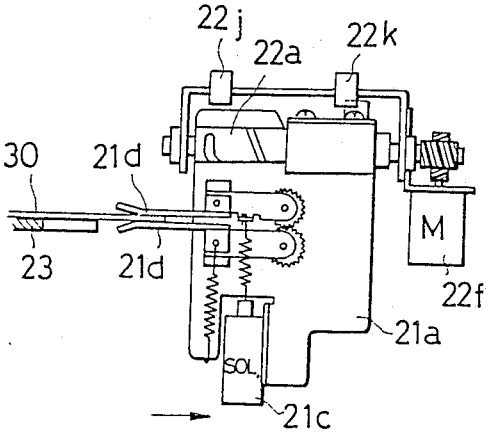

Attached to the support frame 22*b* are horizontally spaced position sensors 22*j* and 22*k* each of which detects a projection 22*m* secured to the base plate 21*a* and produces an output signal for controlling the drive motor 22*f* so as to advance and retract the chuck plates 21*d* in a horizontal direction within a distance which is equal to that between the sensors 22*j* and 22*k*, as seen in FIGS. 4 to 6.

In the emobodiment having the above-described construction, when a stapling mode of the operation is started, the stapler-head 1 and the sheet attracting unit 2 are vertically moved in unison by a drive force of the drive motor 9 toward their predetermined first positions at which the stapler-head 1 and the chuck plates 21*d* of the sheet attracting unit 2 confront one end of a predetermined bin 23, for example, the uppermost bin, on which a stack of sheets 30 to be firstly stapled are stored. When the stapler-head 1 and the sheet attracting unit 2 arrive in unison at their first predetermined positions as shown in FIG. 4, the drive motor 9 is deactivated on the basis of the detection of the corresponding pillar projection 16*a* by the position sensor 15. In this state, the chuck plates 21*d* are maintained both in their predetermined horizontally retracted positions and in their open positions.

The feed shaft 22*a* is then rotated forwardly by a drive force of the drive motor 22*f*, causing the chuck plates 21*d* to advance horizontally from their predetermined horizontally retracted positions. When the chuck plates 21*d* arrives at their predetermined horizontally advanced positions, as shown in FIG. 5, the drive motor 22*f* is deactivated on the basis of the detection of the base plate projection 22*m* by the position sensor 22*j*, and at the same time, the solenoid 21*c* is energized to move the chuck plates 21*d* toward their closed positions so as to chuck therebetween the sheets 30 stacked on the bin 23, as shown in FIG. 5.

The feed shaft 22*a* is then reversed by the motor 22*f*, causing the base plate 21*a* to return horizontally toward their predetermined retracted positions, with the sheets 30 chucked therebetween, as shown in FIG. 6. When the chuck plates 21*d* arrive at their predetermined retracted positions, the motor 22*f* is deactivated, and the stapler-head 1 is actuated to effect a stapling operation on the sheets 30 chucked by the chuck plates 21*b*.

Figure 7:
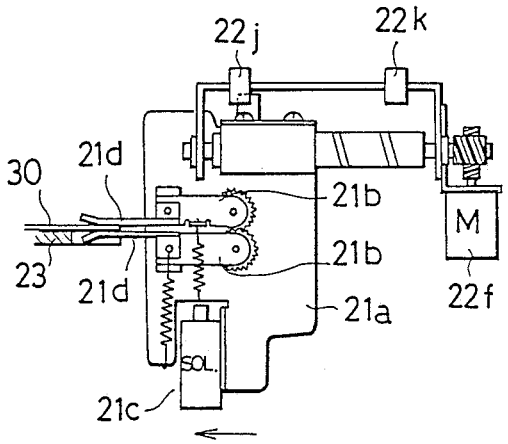
Figure 8:
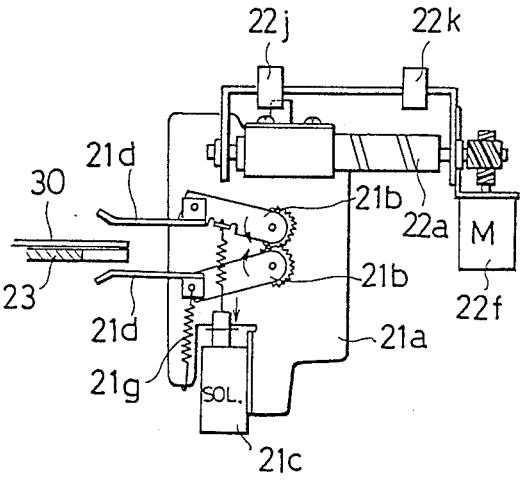

When the stapling operation of the stapler-head 1 is completed, the motor 22*f* is energized to rotate the feed shaft 22*a* in a forward directon, causing the chuck plates 21*d* to advance horizontally toward their predetermined advanced positions, with the sheets 30 chucked therebetween. When the chuck plates 21*d* arrive at their predetermined advanced positions as shown in FIG. 7, the motor 22*f* is deactivated to stop the base plate 21*a*, and then the solenoid 21*c* is deactivated to release the chuck plates 21*d* from the sheets 30, as shown in FIG. 8.

Figure 9:
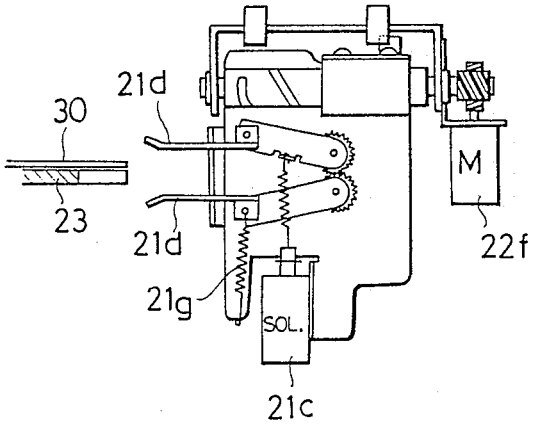

Then, the chuck plates 21*d* are returned to their predetermined retracted positions, as shown in FIG. 9. In this way, one cycle of operation of the stapling apparatus per one bin is completed.

Then, the stapler-head 1 and the sheet attracting unit 2 are vertically moved in unison toward their next predetermined positions where the above-described operation is repeated.

Figure 10:
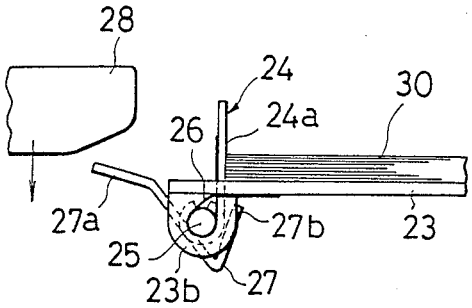
FIG. 10 is a partial side view illustrating on an enlarged scale, a fence releasing mechanism of the sheet stapling apparatus shown in FIG. 1.
Figure 11:
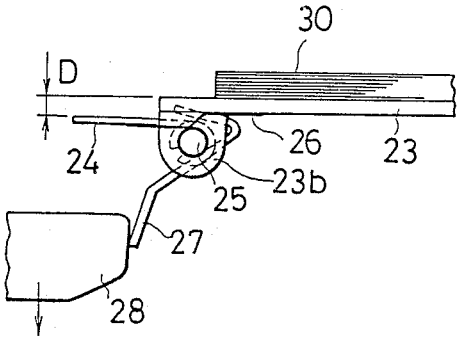
FIGS. 11 and 12 are partial side views illustrating on an enlarged scale, the operative state of the fence releasing mechanism shown in FIG. 10.
Figure 12:
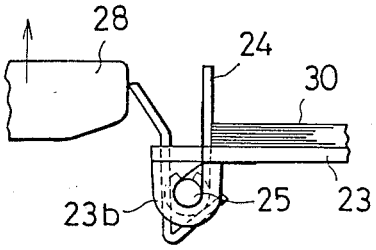

FIGS. 10 to 12 illustrate a fence or sheet stopper and a fence releasing mechanism provided in the above-described embodiment of the present invention. Referring to FIGS. 10 to 12, a movable fence 24 for aligning side edges of the sheets 30 is provided on each bin 23. In this embodiment, the fence 24 is pivoted to the bin 23 through a support shaft 25. In this embodiment, the support shaft 25 is rotatably supported at opposite ends thereof to the bin 23 so as to extend in parallel to the one side of the bin 23 along the under side of the bin 23, while the fence 24 is rotatably fitted over the shaft 25. Accordingly, the fence 24 is rotatable about the shaft 25 between an upstanding position thereof shown in FIGS. 10 and 12 and a lying or releasing position thereof shown in FIG. 11. When maintained in the upstanding position, the fence 24 forms a front surface 24*a* for making contact with the side edges of the sheets 30 for alignment thereof, as shown in FIGS. 10 and 12. On the other hand, when maintained in the lying or releasing position, the fence 24 is located slightly under the upper surface of the bin 23, as shown in FIG. 11. A spiral spring 26 which is mounted on the shaft 25 has opposite ends which are forced against the under surface of the bin 23 and the back side of the fence 24, respectively, thereby urging the fence 24 to rotate toward the upstanding position thereof. Vent downwardly from the bin 23 at one side thereof are support plates 23*b* (only one of them is shown in the Figures) for rotatably supporting the shaft 25.

The fence releasing mechanism shown in FIGS. 10 to 12 is provided for tilting the fence 24 about the shaft 25 from the upstanding position thereof to the releasing position thereof in accordance with the vertical movement of the stapler-head 1. As shown in FIG. 10, the fence releasing mechanism comprises an operation lever 27 secured to the shaft 25 and a releasing lever 28 which is movable together with the stapler-head 1 and the sheet attracting unit 2 in upward and downward dierctions. The operation lever 27 is bent in the form of a V-shape so as to have a first and second tip ends 27*a* and 27*b* and a V-shaped end. The operation lever 27 is secured at the inside of the V-shaped end thereof to the shaft 25 in such a manner that when the operation lever 27 is maintained in an initial position thereof, the second tip end 27*b* extends along the front side 24*a* of the fence 24 maintained in its upstanding position, and the first tip end 27*a* extends toward the stapler-head 1. Since the fence 24 is rotatably mounted on the shaft 25 to which the operation lever 27 is secured, as described above, the fence 24 and the operation lever 27 are rotatable with respect to each other about the central axis of the shaft 25. On the other hand, the releasing lever 28 extends toward the bin 23 so that when the releasing lever 28 moves in downward and upward directions, the releasing lever 28 can abut the first tip end 27*a* of the operation lever 27, thereby rotating it in downward and upward directons about the central axis of the shaft 25, respectively.

When the first tip end 27*a* of the lever 27 is pushed downwardly by the releasing lever 28 from a position shown in FIG. 10 to a position shown in FIG. 11, the second tip end 27*b* of the lever 27 forces against the front side 24*a* of the fence 24 to tilt from its upstanding position to the its releasing position. When the releasing lever 28 is disconnected downwardly from the first tip end 27*a* of the operation lever 27, the fence 24 is returned toward its upstanding position by a spring force of the spring 26.

On the other hand, when the first tip end 27*a* of the lever 27 is pushed upwardly by the releasing lever 28 from a position shown in FIG. 10 to a position shown in FIG. 12, the second tip end 27*b* of the lever 27 is rotated separately from the fence 24, and thus, the fence 24 is maintained in its upstanding position. Further, when the releasing lever 28 is disconnected upwardly from the releasing lever 28, the operation lever 27 is returned to its initial position shown in FIG. 10 by the weight of itself.

In the above-mentioned embodiment according to the present invention, each fence 24 is maintained in the upstanding position thereof by a spring force of the corresponding spiral spring 26 during the sorting operation of the sorter. Accordingly, when each of the sheets 30 is fed onto the bin 23, it becomes in contact at its side edge with the front side 24*a* of the fence 24, and thus, the sheets 30 stacked on the bin 23 are aligned along the fence front side 24*a*.

After the sorting operation is completed, the stapler-head 1, the sheet attracting unit 2, and releasing lever 28 are vertically moved in unison from their home positions to their predetermined first positions. In this embodiment, such home positions are located above the position of the uppermost bin, and the stapler-head 1, the sheet attracting unit 2, and releasing lever 28 are downwardly moved in unison from their home positions for effecting the first stapling operation in a stack of sheets stored on the uppermost bin.

When the releasing lever 28 is moved downwardly from a position shown in FIG. 10 to a the position shown in FIG. 11, the fence 24 is moved from its upstanding position to its releasing position, as described above. When the stapler-head 1 is maintained in one of the predetermined positions, the relationship between the releasing lever 28 and the operation lever 27 as shown in FIG. 11 is maintained, thereby permitting the sheets 30 on the bin 23 to be attracted by the sheet attracting unit 2. In this state, the above-described operations of the sheet attracting untit 2 and the stapler-head 1 are carried out.

After the sheets 30 chucked by the chuck plates 21*d* of the sheet attracting unit 2 is stapled, the sheets 30 are returned toward the initial position thereof by the sheet attracting unit 2. In this embodiment, when the sheets 30 are completely returned to their initial position, downward movements of the stapler-head 1, the sheet attracting unit 2, and the releasing lever 28 is started again for effecting the second stapling operation. Alternatively, such downward movements may be started before the sheets 30 are completely returned to the initial position.

After the final set of sheets are stapled, the stapler-head 1, the sheet attracting unit 2, and releasing lever 28 are moved upwardly in unison toward their home positions.

Figure 13:
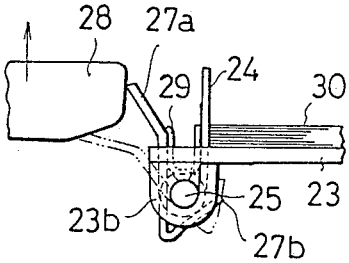
FIG. 13 is a partial side view illustrating on an enlarged scale, a fence releasing mechanism of a stapling apparatus according to another preferred embodiment of the present invention.

FIG. 13 illustrates another preferred embodiment of the present invention. The construction of the embodiment shown in FIG. 13 is substantially the same as that of the above-mentioned embodiment shown in FIGS. 1 to 12, except that between the first tip end 27*a* of the operation lever 27 and the fence 24, there is provided a resilient member 29, such as a leaf spring, a coil spring, a rubber block or the like, for forcing the first tip end 27*a* of the releasing lever 27 from the fence 24 so as to increase the distance therebetween. In this embodiment, the resilient member 29 serves the operation lever 27 to return to its initial position shown by a phantom line in FIG. 13 from the position shown by a solid line in FIG. 13, after the releasing lever 28 is disconnected upwardly from the first tip end 27*a* of the operation lever 27.

Although a single stapler-head 1 is employed in the above-described embodiments, two or more stapler-heads may be provided for stapling each sets of sheets at two or more positions thereof if desired. Further, two pairs of swingable arms, each provided with a pair of chuck plates, may be provided for chucking each set of sheets at two spaced positions thereof.

While the invention has been described in conjunction with specific embodiments thereof, it is evident that many alternatives, modifications, and variations will be apparent to those skilled in the art in light of the foregoing description. Accordingly, it is intended to include all such alternatives, modifications and variations as fall within the spirit and scope of the appended claims.

What is claimed is:

1. A stapling apparatus used in combination with a sheet sorter having a plurality of bins for storing thereon sheets sorted by the sheet sorter, comprising:

a stapler-head for striking at least one staple into the sheets stacked on each of said bins near one side edge of the sheets, said stapler-head being movable along one side edge of said bins and able to be stopped at each of predetermined positions at which said stapler-head confronts said one side edge of said bins; and a sheet attracting means for chucking the sheets stacked on each of said bins near said one side edge of the sheets and for moving the sheets outwardly from one side edge of the corresponding bin to a predetermined position at which said stapler-head becomes able to strike the staple into said one side edge of the sheets, said sheet attracting means being movable along said one side edge of said bins and able to be stopped at each of predetermined positions at which said sheet attracting means confronts said one side edge of said bins.

2. A stapling apparatus according to claim 1, further comprising means for vertically moving said stapler-head and said sheet attracting means in unison along said one side edge of said bins and stopping the movements thereof at said respective positions at which said stapler-head and said sheet attracting means confront said one side edge of said bins.

3. A stapling apparatus according to claim 1, wherein said sheet attracting means comprises:

a chucking means for chucking and releasing the sheets stacked on each of said bins; and a reciprocating means for reciprocating said chucking means in substantially a horizontal direction between a first position at which said chucking means becomes able to chuck said one side edge of the sheets stacked on each of said bins and a second position at which said stapler-head becomes able to strike the staple into said one side edge of the sheets.

4. A stapling apparatus according to claim 1, further comprising a first detecting means for detecting presence of said chucking means on said first and second positions to produce an output signal for the contol of said recipriocating means.

5. A stapling apparatus according to claim 3, wherein said chucking means comprises:

a support base which is adapted to be reciprocated by said reciprocating means in substantially a horizontal direction;

a pair of vertically spaced chucking members which are pivotally mounted at their one ends to said support base;

a pair of gears integrally provided on said one ends of said chucking members, respectively, and intermeshing with each other so as to povide symmetrical swing movements on said chucking members about their pivot axes between their open and closed positions; and an actuating means provided on said support base for moving said chucking members between their open and closed positions and maintaining said chucking members in their open and closed positions.

6. A stapling apparatus according to claim 3, wherein said reciprocating means comprises:

a support bracket which is moved vertically together with said stapler-head and said sheet attracting means along said one side edge of said bins;

a feed shaft rotatably supported to said support bracket for rotation about a central axis thereof and extending horizontally and perpendicularly to said one side edges of said bins;

a nut member secured to said support base of said chucking means and threaded on said feed shaft so as to be reciprocated horizontally along said feed shaft in accordance with forward and reverse rotations of said feed shaft; and means for rotating said feed shaft in forward and reverse directions.

7. A stapling apparatus according to claim 2, wherein said means for vertically moving said stapler head comprises:

a base member for fixedly supporting thereon said stapler-head and said sheet attracting means;

a guiding means for movably guiding said base member in a vertical direction along said one side edges of said bins;

a base drive means for moving said base member in upward and downward direction along said guide means; and a second detecting means for detecting presence of said stapler-head and said sheet attracting means on said respective predetermined vertically spaced positions to produce an output signal for the control of said base drive means.

8. A stapling apparatus according to claim 7, wherein said guiding means comprises a pair of stationary guide rails extending vertically in parallel to each other along said one side edge of said bins and having guide grooves, respectively, said base member being provided at opposite ends thereof with guide rollers, respectively, which are rotatably mounted to said base member and received into said guide grooves of said guide rails for rolling along said guide grooves, respectively.

9. A stapling apparatus according to claim 7, wherein said drive means comprises:

a pair of drive belts extending vertically in parallel to each other along said one side edges of said bins, said base member being secured at opposite ends thereof to said drive belts, respectively;

two pair of vertically spaced end rollers for supporting said drive belts, respectively;

a drive motor for rotating said end rollers in forward and reverse directions, said drive motor being controlled by said second detecting means; and a power transmitting means for operatively connecting said drive motor and said end rollers.

10. A stapling apparatus according to claim 1 further comprising:

a plurality of fences for aligning said one side edge of the sheets stacked on the respective bins, each of said fences being movably attached to the corresponding bins for movement in opposite directions between an upstanding position thereof at which the fence forms a surface for making contact with said one side edge of the sheets stacked on the corresponding bin and a releasing position thereof at which the fence permits said one side edge of the sheets stacked on the corresponding bin to move outwardly from the one side edge of the corresponding bin;

a plurality of spring members provided on said bins, respectively, for forcing the respective fences to move toward the upstanding positions thereof; and an operating means for moving said fences from the upstanding positions thereof to the releasing positions thereof against said spring members, respectively, in accordance with the movement of said stapler-head along said one side edges of said bins so as to maintain said fences in the respective releasing positions when said stapler-head is maintained in said predetermined respective positions.

11. A stapling apparatus according to claim 10, wherein said operating means comprises:

a plurality of operation levers each being movable with respect to the corresponding bin and the corresponding fence for movement in opposite directions and having a first tip end which extends toward said stapler-head when maintained in its initial position and a second tip end which extends along the corresponding fence when said first tip end is maintained in the initial position, the second tip end of each of said operation levers being adapted to force the corresponding fence to move from said upstanding position to said releasing position when the first tip end of each of said operation levers is moved downwardly from the initial position; and a releasing lever being moved vertically together with said stapler-head and said sheet attracting means and adapted to force against each of the first ends of said operation levers to move downwardly and upwardly when it moves downwardly and upwardly.

12. A stapling apparatus according to claim 10, wherein each of said fences and the corresponding operation lever ar indepedently pivoted to the corresponding bin through a pivot shaft.

13. A stapling apparatus according to claim 10, wherein said fences and the corresponding operation levers are provided therebetween with resilient members, each adapted to force the first tip end of the corresponding operation to move downwardly toward the initial position when the corresponding fence is maintained in said upstanding position.

* * * * *